US012779312B2

(12) United States Patent
Huang

(10) Patent No.: US 12,779,312 B2
(45) Date of Patent: Nov. 3, 2026

(54) SPORT SIMULATION DEVICE

(71) Applicant: BENQ CORPORATION, Taipei City (TW)

(72) Inventor: Chih-Pen Huang, New Taipei City (TW)

(73) Assignee: BENQ CORPORATION, Taipei City (TW)

( * ) Notice: Subject to any disclaimer, the term of this patent is extended or adjusted under 35 U.S.C. 154(b) by 89 days.

(21) Appl. No.: 19/088,923

(22) Filed: Mar. 24, 2025

(65) Prior Publication Data

US 2026/0021366 A1 Jan. 22, 2026

(30) Foreign Application Priority Data

Jul. 22, 2024 (TW) ..... 113127301

(51) Int. Cl.
*A63B 71/06* (2006.01)
*A63B 24/00* (2006.01)
*A63B 102/32* (2015.01)

(52) U.S. Cl.
CPC ..... *A63B 71/0622* (2013.01); *A63B 24/0003* (2013.01); *A63B 2071/0638* (2013.01); *A63B 2102/32* (2015.10); *A63B 2220/806* (2013.01)

(58) Field of Classification Search
None
See application file for complete search history.

(56) References Cited

U.S. PATENT DOCUMENTS 6,358,164 B1 * 3/2002 Bracewell ..... A63B 71/0605 473/454
6,793,585 B1 * 9/2004 Miyamoto ..... A63B 24/0003 473/150
9,199,153 B2 * 12/2015 Dawe ..... G06F 3/017
9,211,439 B1 * 12/2015 Pedenko ..... A63B 69/36
9,268,406 B2 * 2/2016 Geisner ..... H04N 13/344
9,345,957 B2 * 5/2016 Geisner ..... A63F 13/21
9,462,253 B2 * 10/2016 Hudman ..... G01S 17/89
9,606,992 B2 * 3/2017 Geisner ..... G09G 3/003
11,627,300 B2 * 4/2023 Banks ..... G01S 17/10 348/46

(Continued)

FOREIGN PATENT DOCUMENTS

JP 2018-959 A 1/2018
JP 2018-57015 A 4/2018

(Continued)

*Primary Examiner* — Paul A D'Agostino
(74) *Attorney, Agent, or Firm* — Winston Hsu

(57) ABSTRACT

A sport simulation device includes a camera module, a projector module and an operation processor. The camera module captures a top view image relevant to a user. The projector module is integrated with the camera module. The operation processor is electrically connected to the camera module and the projector module. The operation processor can analyze the top view image to find out a predefined feature of the user, divide the top view image into a first region and a second region in accordance with the predefined feature, and drive the projector module to project one of the first region and the second region onto a supporting plate where on the user stands in accordance with the predefined feature.

10 Claims, 5 Drawing Sheets

(56) References Cited

U.S. PATENT DOCUMENTS

2002/0186221 A1* 12/2002 Bell ..... G03B 21/26 348/E5.029
2003/0040381 A1* 2/2003 Richings ..... A63B 69/406 473/569
2004/0102247 A1* 5/2004 Smoot ..... G07F 17/32 463/36
2004/0198524 A1* 10/2004 Kwon ..... A63B 24/0021 473/151
2005/0153785 A1* 7/2005 Sun ..... A63B 24/0003 473/151
2005/0215336 A1* 9/2005 Ueda ..... A63B 24/0003 473/131
2006/0247070 A1* 11/2006 Funk ..... A63B 69/3623 473/222
2007/0072159 A1* 3/2007 Olson ..... A63B 69/3623 434/252
2007/0135225 A1* 6/2007 Nieminen ..... A63B 69/36 473/409
2009/0017929 A1* 1/2009 Zhang ..... A63B 69/3608 473/409
2010/0081116 A1* 4/2010 Barasch ..... G09B 19/0038 434/308
2011/0299729 A1* 12/2011 Dawe ..... G06T 7/246 382/103
2012/0075697 A1* 3/2012 Astill ..... G03B 21/58 359/461
2013/0095924 A1* 4/2013 Geisner ..... A63F 13/21 463/32
2013/0095961 A1* 4/2013 Marty ..... A63B 24/0084 473/450
2014/0003666 A1* 1/2014 Park ..... G09B 19/0038 382/103
2014/0004969 A1* 1/2014 Jang ..... G06T 7/248 473/409
2014/0186005 A1* 7/2014 Takagi ..... G11B 27/005 386/224
2014/0198962 A1* 7/2014 Anabuki ..... G06T 7/0014 382/128
2014/0254883 A1* 9/2014 Kim ..... G06V 10/764 382/107
2014/0357393 A1* 12/2014 Senno ..... G09B 19/0038 473/223
2015/0310382 A1* 10/2015 Holman ..... G06Q 10/083 700/235
2015/0319424 A1* 11/2015 Haimovitch-Yogev ..... G01B 11/245 348/48
2015/0352437 A1* 12/2015 Koseki ..... A63F 13/5255 463/31
2015/0381886 A1* 12/2015 Kato ..... H04N 23/661 348/207.1
2016/0151696 A1* 6/2016 Chen ..... A63B 24/0006 473/199
2016/0243423 A1* 8/2016 Tuxen ..... A63B 24/0003
2018/0137363 A1* 5/2018 Campagnoli ..... G06V 20/42
2019/0022492 A1* 1/2019 Takahashi ..... G06T 19/00
2019/0105546 A1* 4/2019 Ferrara ..... A63B 21/4037
2019/0278091 A1* 9/2019 Smits ..... G03B 35/18
2019/0318177 A1* 10/2019 Steinberg ..... G01S 7/026
2020/0128902 A1* 4/2020 Brown ..... A42B 3/30
2020/0129809 A1* 4/2020 Suk ..... A63B 24/0006
2020/0398110 A1* 12/2020 Kosowsky ..... A63B 69/36
2021/0117680 A1* 4/2021 Chaudhri ..... G06V 20/20
2022/0161117 A1* 5/2022 Jessop ..... G16H 50/30
2022/0345660 A1* 10/2022 Jayaram ..... G06T 7/73
2022/0400235 A1* 12/2022 Spurgat ..... G06F 1/163
2023/0072561 A1* 3/2023 Yoon ..... A63B 69/3608
2023/0077073 A1* 3/2023 Kim ..... G02B 27/0093
2023/0145451 A1* 5/2023 Håkansson ..... A61B 5/744 482/8
2023/0213610 A1* 7/2023 Eberspach ..... G01B 11/2513
2023/0241483 A1* 8/2023 Yoo ..... A63B 71/0622 434/247
2023/0280821 A1* 9/2023 Kocienda ..... G06F 3/011 345/156
2023/0283885 A1* 9/2023 Kocienda ..... H04N 9/3179 348/207.99
2023/0283886 A1* 9/2023 Kocienda ..... G06V 10/147
2023/0372803 A1* 11/2023 Kweon ..... A63B 24/0006

FOREIGN PATENT DOCUMENTS

JP 2022-105271 A 7/2022
JP 2022-185742 A 12/2022

* cited by examiner

SPORT SIMULATION DEVICE

BACKGROUND OF THE INVENTION

1. Field of the Invention

The present invention relates to a sport simulation device, and more particularly, to a sport simulation device of reading and displaying sport information of the user.

2. Description of the Prior Art

With the advanced technology, indoor simulated sports gradually become popular; for example, the indoor simulated golf course is more well-known because it requires a much smaller area than the real golf course. The conventional indoor simulated golf course projects the course image onto a projection screen in front of the user, and analyzes the speed, position, and distance of the golf ball, to provide batting information for the user. The camera device, the display device and the computation device of the conventional indoor simulated golf course are independent and placed on separated positions, which have disadvantages of complicated installation and unclear display. Besides, the user's standing position is limited by machine position of the conventional indoor simulated golf course. Design of an integrated indoor golf simulation device that can read and display the user's sport information is an important issue in the sport equipment industry.

SUMMARY OF THE INVENTION

The present invention provides a sport simulation device of reading and displaying sport information of the user for solving above drawbacks.

According to the claimed invention, a sport simulation device includes a camera module, a projector module and an operation processor. The camera module is adapted to capture a top view image relevant to a user. The projector module is integrated with the camera module. The operation processor is electrically connected to the camera module and the projector module. The operation processor is adapted to analyze the top view image for finding out a predefined feature of the user, divide the top view image into a first region and a second region in accordance with the predefined feature, and drive the projector module to project one of the first region and the second region onto a supporting plate where on the user stands in accordance with the predefined feature.

According to the claimed invention, the operation processor is adapted to drive the projector module to project the second region of the top view image onto the supporting plate when determining that the user stands on position corresponding to the first region of the top view image in accordance with the predefined feature. The operation processor is adapted to hide or discard the first region of the top view image, and only transmits the second region of the top view image to the projector module. The camera module and the projector module are located directly above the user.

According to the claimed invention, the camera module includes a vertical-cavity surface-emitting laser (VCSEL) unit and a time of flight (ToF) sensor, the VCSEL unit generates a structured laser signal, and the ToF sensor receives the structured laser signal reflected from the user to form a point cloud structure diagram. The camera module further includes a color sensor adapted to acquire image information of the user and related environment for auxiliary computation. The sport simulation device further includes a case, the camera module and the projector module and the operation processor are disposed inside the same case.

The sport simulation device of the present invention can integrate the camera module and the projector module into the same case, and the camera module is very close to the projector module (for example, the distance between the camera module and the projector module can be preferably smaller than ten centimeter), so that the camera module and the projector module integrated with each other can be located directly above the user. The sport simulation device can project the image content that contains a golf court, batting suggestion and clubs operation onto the supporting plate, and capture images about the user's batting posture and batting results directly below, and further project the top view image about the batting posture of the user and the related batting suggestion and the related clubs operation onto the supporting plate where the user stands, for being the auxiliary reference of next shot. Comparing to the prior art, the sport simulation device of the present invention is not limited by position of the user, and can automatically identify the batting position of the user to process and output the corresponding top view image, for rapidly and accurately providing sport information to improve training efficiency.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
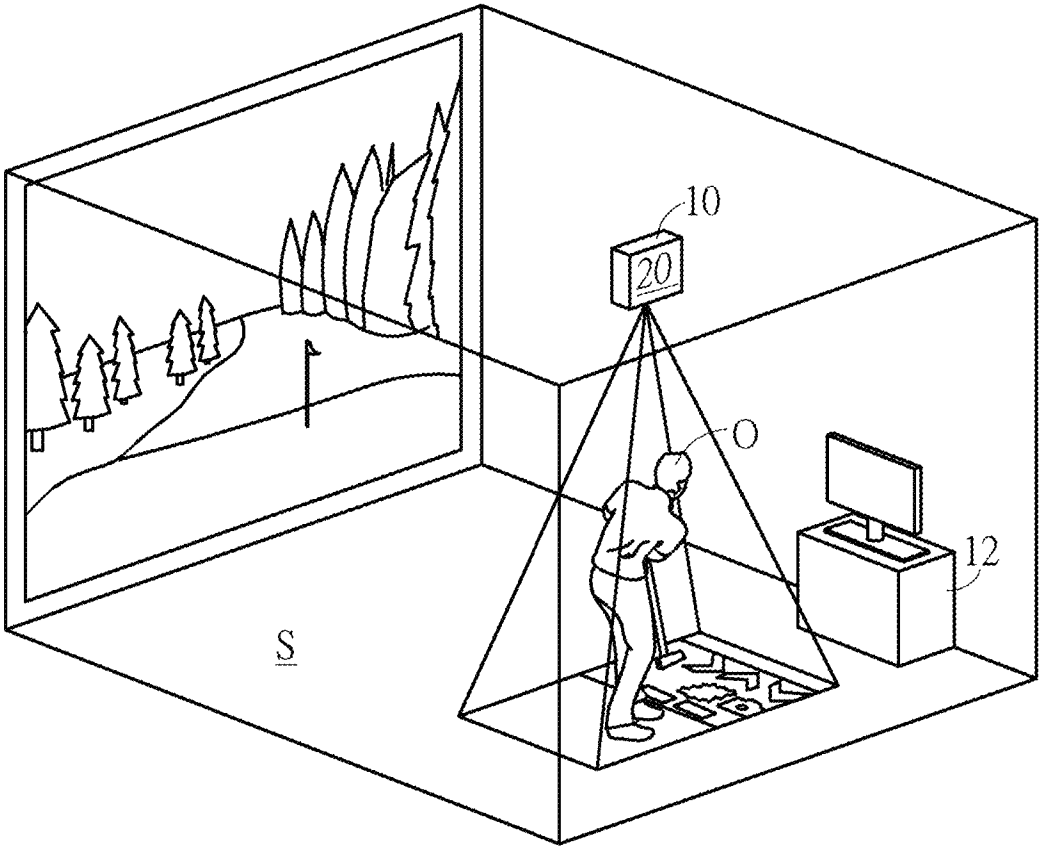
FIG. 1 is an application diagram of a sport simulation device according to an embodiment of the present invention.
Figure 2:
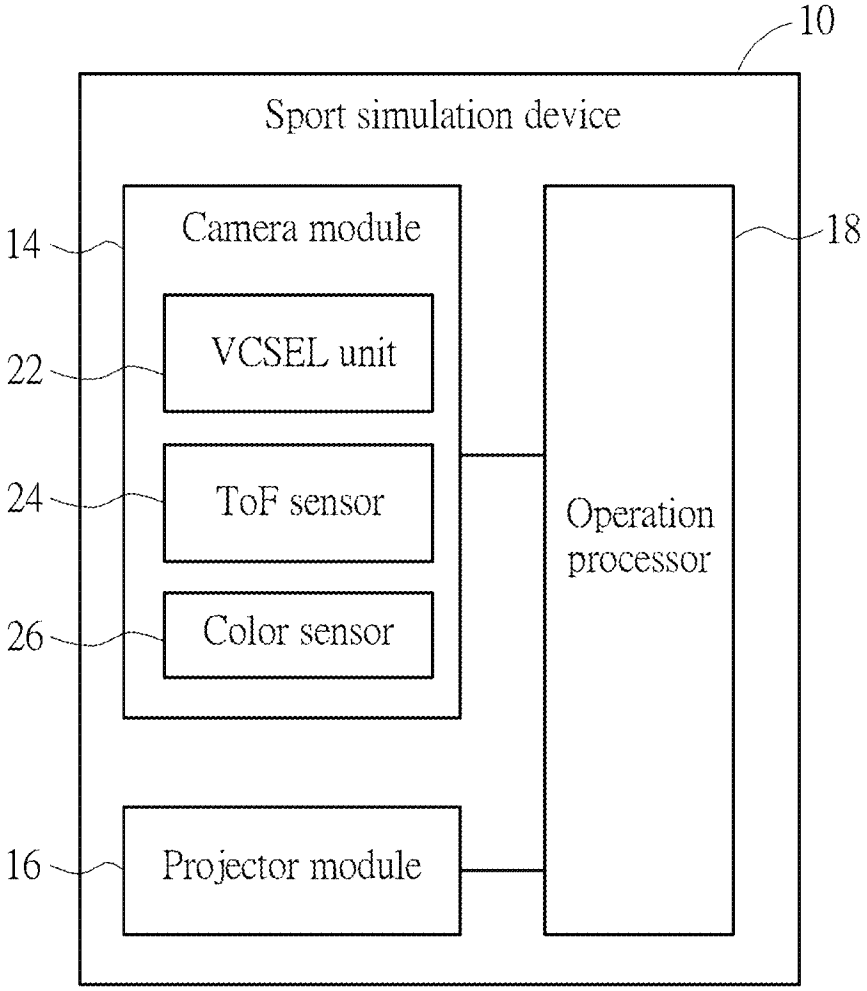
FIG. 2 is a functional block diagram of the sport simulation device according to the embodiment of the present invention.

Please refer to FIG. 1 and FIG. 2. FIG. 1 is an application diagram of a sport simulation device 10 according to an embodiment of the present invention. FIG. 2 is a functional block diagram of the sport simulation device 10 according to the embodiment of the present invention. In the present invention, the sport simulation device 10 can be a golf indoor simulator applied for an external computer device 12, such as a desktop computer or a notebook computer, but the actual application of the external computer device 12 is not limited to above embodiments. The sport simulation device 10 can be electrically connected to the external computer device 12 in a wired manner or in a wireless manner. The sport simulation device 10 can be a projection apparatus with a motion analysis function, which can analyze body posture, clubs change and/or batting results of a user O, and transmit the analysis result to the external computer device 12 for following operation.

Figure 3:
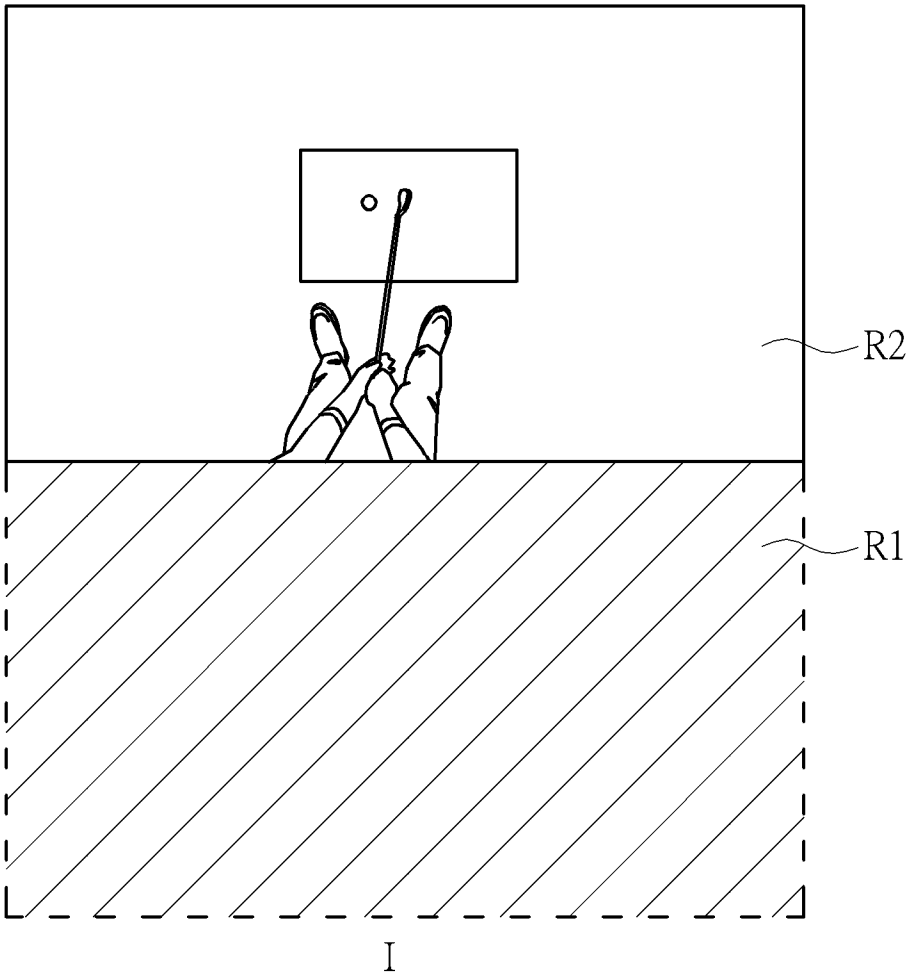
FIG. 3 is a diagram of a top view image captured by the sport simulation device according to the embodiment of the present invention.

Please refer to FIG. 3. FIG. 3 is a diagram of a top view image I captured by the sport simulation device 10 according to the embodiment of the present invention. The sport simulation device 10 can include a camera module 14, a projector module 16, an operation processor 18 and a case 20. The camera module 14 can capture the top view image I relevant to the user O. The projector module 16 can be integrated with the camera module 14. The camera module 14 and the projector module 16 of the sport simulation device 10 can be disposed inside the same case 20, and a distance between the camera module 14 and the projector module 16 can be preferably smaller than ten or fifteen centimeter. The operation processor 18 can be electrically connected to the camera module 14 and the projector module 16, and disposed inside the case 20.

Figure 4:
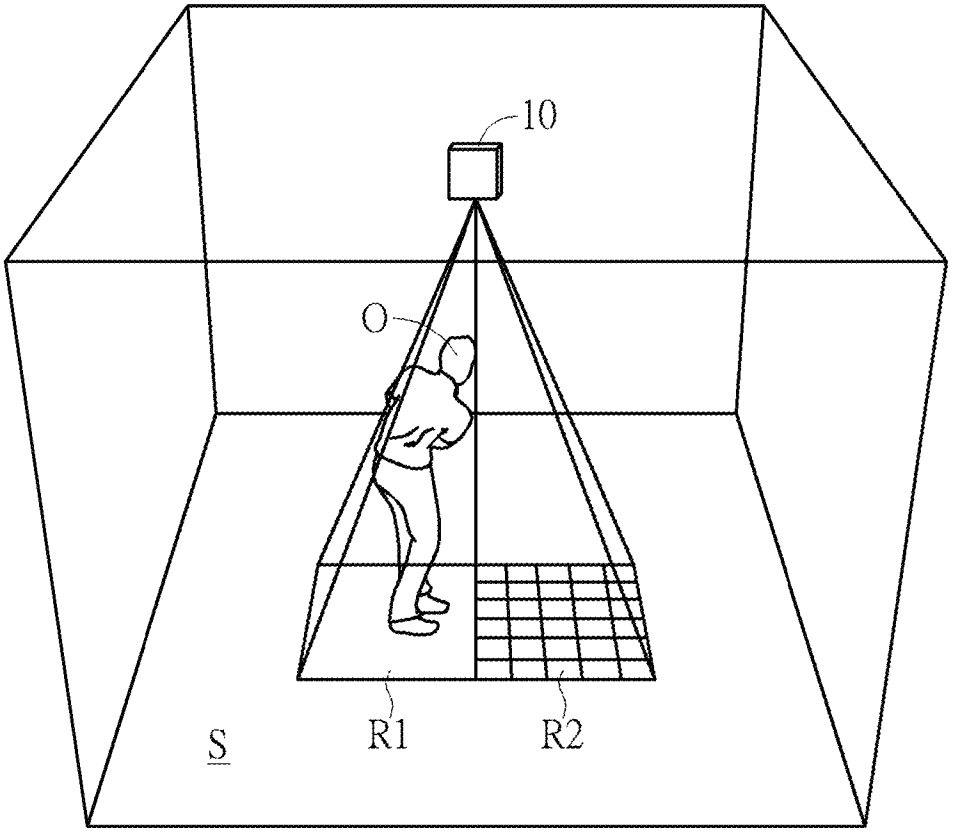
FIG. 4 and FIG. 5 are application diagrams of the sport simulation device in another situation according to the embodiment of the present invention.
Figure 5:
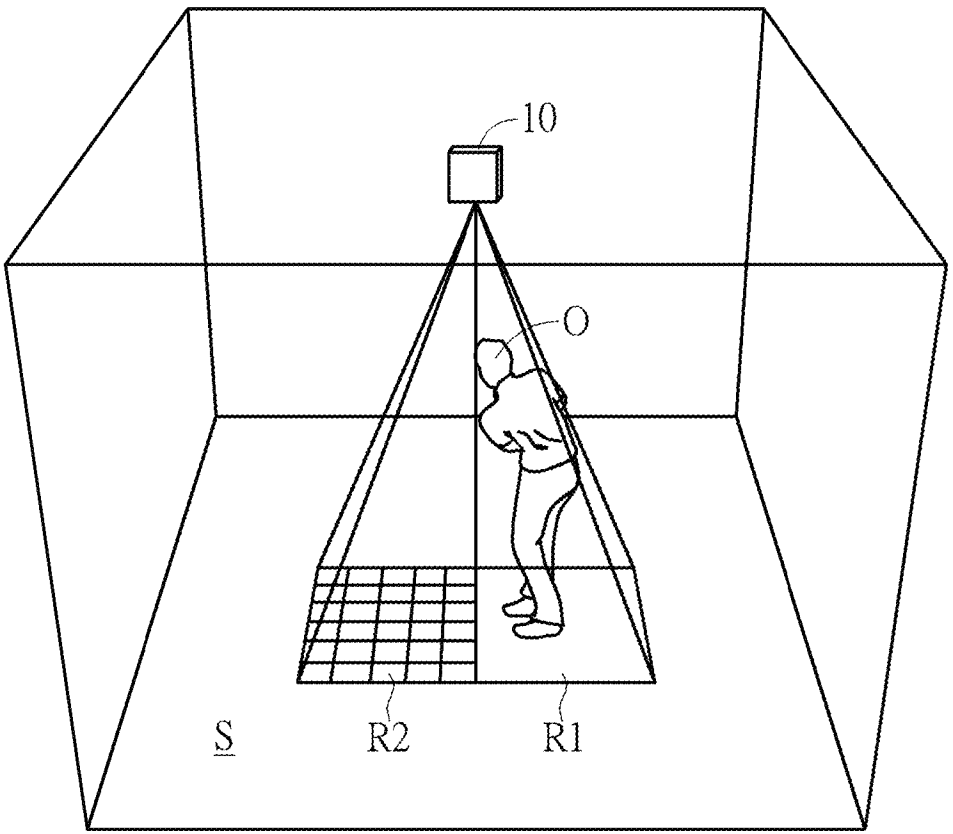

Please refer to FIG. 4 and FIG. 5. FIG. 4 and FIG. 5 are application diagrams of the sport simulation device 10 in another situation according to the embodiment of the present invention. The sport simulation device 10 can utilize the camera module 14 to capture the top view image I of the user O, for acquiring an appearance and a depth and a posture of the user O and a shape and an appearance of a related clubs and a related ball. The operation processor 18 can analyze the top view image I to find out a predefined feature of the user O, and divide the top view image I at least into a first region R1 and a second region R2 in accordance with the predefined feature. The predefined feature can be a hand or a foot of the user O, or the golf clubs held by the user O, or the ball near the golf clubs held by the user O.

For example, the sport simulation device 10 can define a region of the top view image I which corresponds to position of the user O as the first region R1, and other region of the top view image I that contains images of the hand or the foot of the user O, or the golf clubs held by the hand of the user O, or the ball near the golf clubs held by the user O as the second region R2. The sport simulation device 10 can immediately provide information of the body posture, the clubs change and/or the batting result of the user O, and the user O can view the foresaid information to correct the body posture accordingly; when the operation processor 18 determines the user O standing on the first region R1 of the top view image I in accordance with the predefined feature, the operation processor 18 can drive the projector module 16, which is directly located above the user O, to project the second region R2 of the top view image I onto the supporting plate S where on the user O stands. The sport simulation device 10 can be preferably placed on position directly above the user O, but the actual application is not limited to above embodiment.

For example, the sport simulation device 10 may be optionally placed on another position near an upper side of the user O (such as position diagonally in front of or behind the user), and project the top view image I onto the supporting plate S in an oblique projection method. The sport simulation device 10 including the camera module 14 and the projector module 16 integrated inside the same case 20 can be placed anywhere above the user O, and can conform to requirements for downward capturing of the camera module 14 and downward projection of the projector module 16 and therefore belong to a design scope of the present invention.

The operation processor 18 can only transmit the second region R2 of the top view image I to the projector module 16 for projection, and image content about the first region R1 of the top view image I can be discarded accordingly; or, the operation processor 18 may still transmit the top view image I to the projector module 16, and the first region R1 of the top view image I can be shaded or presented in a specific pattern (e.g. mosaic or checkered patterns), and the projector module 16 can only project the second region R2 of the top view image I onto the supporting plate S, which means the image content about the first region R1 of the top view image I is hidden. The present invention is not limited to discarding or hiding the image content of the first region R1 of the top view image I; any method that can avoid the image content of the first region R1 from appearing on the supporting plate S can conform to the design scope of the present invention.

As shown in FIG. 3 and FIG. 4, the user O stands on the left side of the sport simulation device 10, so that the left region of the top view image I can be defined as the first region R1 that is shaded, and the right region of the top view image I can be defined as the second region R2 for projecting onto the supporting plate S to show the body posture, the clubs change and/or the batting result of the user O. As shown in FIG. 3 and FIG. 5, the user O stands on the right side of the sport simulation device 10, so that the right region of the top view image I can be defined as the first region R1 that is shaded, and the left region of the top view image I can be defined as the second region R2 for projecting onto the supporting plate S to show the body posture, the clubs change and/or the batting result of the user O.

In the present invention, when the sport simulation device 10 detects the predefined feature of the user O inside the top view image I, the sport simulation device 10 can set a specific range of the top view image I as the second region R2 based on the predefined feature, and other range of the top view image I excluding the second region R2 can be set as the first region R1; in this embodiment, a size of the first region R1 can be different from a size of the second region R2, but the actual application is not limited to above situation. For example, the sport simulation device 10 may equally divide the top view image I into the first region R1 and the second region R2, and analyze coordinate information of the predefined feature within the top view image I; a region of the top view image I where inside the coordinate information of the predefined feature is located can be defined as the second region R2, other region of the top view image I that does not contain the coordinate information of the predefined feature can be defined as the first region R1. Equal division as mentioned above can divide the top view image I along the vertical axis or the horizontal axis, which depends on an actual demand.

For correctly identifying the predefined feature of the user O, the camera module 14 of the sport simulation device 10 can optionally include a vertical-cavity surface-emitting laser unit 22 and a time of flight sensor 24. The VCSEL unit 22 can generate a structured laser signal and project the structured laser signal towards the user O. The ToF sensor 24 can receive the structured laser signal reflected from the user O to form a point cloud structure diagram. The operation processor 18 can utilize spatial data points of the point cloud structure diagram to acquire three dimensional shapes of the hand, the foot, the golf clubs and/or the ball of the user O, so as to correctly identify the predefined feature of the user O. Further, the camera module 14 may include a color sensor 26 used to acquire image information of the user O and related environment, and the image information provided by the color sensor 26 can be used as auxiliary computation in execution of feature identification.

Therefore, the sport simulation device 10 of the present invention can be located directly above the user O, and the projector module 16 can project the top view image I that contains the image content about the batting posture of the user O onto the supporting plate S where the user O stands. The sport simulation device 10 can be designed as only projecting a part of the top view image I that contains the batting posture of the user O onto the supporting plate S for being reference, so that the sport simulation device 10 can identify the predefined feature of the user O within the top view image I by object identification technology, neural network computation, or other identification technology, and automatically discard the region of the top view image I which contains image content of the body of the user O; that is to say, the user O can freely choose the right striking position or the left striking position, and the sport simulation device 10 can automatically detect position of the user O for adaptive adjustment.

In conclusion, the sport simulation device of the present invention can integrate the camera module and the projector module into the same case, and the camera module is very close to the projector module (for example, the distance between the camera module and the projector module can be preferably smaller than ten centimeter), so that the camera module and the projector module integrated with each other can be located directly above the user. The sport simulation device can project the image content that contains a golf court, batting suggestion and clubs operation onto the supporting plate, and capture images about the user's batting posture and batting results directly below, and further project the top view image about the batting posture of the user and the related batting suggestion and the related clubs operation onto the supporting plate where the user stands, for being the auxiliary reference of next shot. Comparing to the prior art, the sport simulation device of the present invention is not limited by position of the user, and can automatically identify the batting position of the user to process and output the corresponding top view image, for rapidly and accurately providing sport information to improve training efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sport simulation device comprising:

a camera module adapted to capture a top view image relevant to a user;

a projector module integrated with the camera module; and an operation processor electrically connected to the camera module and the projector module, the operation processor being adapted to analyze the top view image for finding out a predefined feature of the user, divide the top view image into a first region and a second region in accordance with the predefined feature, and drive the projector module to project one of the first region and the second region onto a supporting plate where on the user stands in accordance with the predefined feature.

2. The sport simulation device of claim 1, wherein the operation processor is adapted to drive the projector module to project the second region of the top view image onto the supporting plate when determining that the user stands on position corresponding to the first region of the top view image in accordance with the predefined feature.

3. The sport simulation device of claim 2, wherein the operation processor is adapted to hide or discard the first region of the top view image, and only transmits the second region of the top view image to the projector module.

4. The sport simulation device of claim 1, wherein the operation processor is adapted to divide the top view image equally into the first region and the second region in accordance with coordinate information of the predefined feature within the top view image.

5. The sport simulation device of claim 1, wherein the camera module and the projector module are located directly above the user.

6. The sport simulation device of claim 1, wherein the camera module comprises a vertical-cavity surface-emitting laser (VCSEL) unit and a time of flight (ToF) sensor, the VCSEL unit generates a structured laser signal, and the ToF sensor receives the structured laser signal reflected from the user to form a point cloud structure diagram.

7. The sport simulation device of claim 6, wherein the camera module further comprises a color sensor adapted to acquire image information of the user and related environment for auxiliary computation.

8. The sport simulation device of claim 1, wherein the predefined feature is a hand of the user, a foot of the user, a clubs held by the hand of the user, or a ball near the clubs hold by the user.

9. The sport simulation device of claim 1, wherein the sport simulation device further comprises a case, the camera module and the projector module and the operation processor are disposed inside the same case.

10. The sport simulation device of claim 9, wherein a distance between the camera module and the projector module is smaller than ten centimeter.

* * * * *